United States Patent [19]

Sauber

[11] Patent Number: 5,014,865

[45] Date of Patent: May 14, 1991

[54] STEM WARE

[76] Inventor: Richard C. Sauber, 2575 27th St., Akron, Ohio 44314

[21] Appl. No.: 498,558

[22] Filed: Mar. 26, 1990

[51] Int. Cl.[5] ..... A47G 19/22

[52] U.S. Cl. ..... 215/99.5; 215/100 R

[58] Field of Search ..... 215/99.5, 100 R; 220/69, 70, 630

[56] References Cited

U.S. PATENT DOCUMENTS

| | | | |
|---|---|---|---|
| 85,834 | 1/1869 | Leach | 215/99.5 |
| 167,053 | 8/1975 | Barrie | 215/99.5 X |
| 654,879 | 7/1900 | Dineen | 215/99.5 X |
| 782,710 | 2/1905 | Weller | 215/99.5 |
| 809,567 | 1/1906 | Henckel | 215/99.5 |
| 1,801,281 | 4/1931 | McEldowney | 215/99.5 X |
| 1,986,958 | 1/1935 | Cooperstein | 215/99.5 |
| 2,054,245 | 9/1936 | Cummins | 215/99.5 X |
| 2,120,862 | 6/1938 | Heller | 215/99.5 |
| 2,169,426 | 8/1939 | Morton | 215/99.5 X |
| 2,171,919 | 9/1939 | Dodge | 215/99.5 X |
| 2,664,004 | 12/1953 | Forman et al. | 215/99.5 |
| 4,681,236 | 7/1987 | Ilk | 215/99.5 |

FOREIGN PATENT DOCUMENTS

| | | | |
|---|---|---|---|
| 146507 | 5/1952 | Australia | 215/99.5 |
| 56453 | 6/1967 | Fed. Rep. of Germany | 215/99.5 |
| 357416 | 12/1905 | France | 215/99.5 |
| 531097 | 1/1922 | France | 215/99.5 |
| 696970 | 1/1931 | France | 215/99.5 |
| 885381 | 9/1943 | France | 215/99.5 |
| 625913 | 8/1977 | France | 215/99.5 |
| 526482 | 5/1955 | Italy | 215/99.5 |

*Primary Examiner*—Sue A. Weaver

*Attorney, Agent, or Firm*—Renner, Kenner, Greive, Bobak, Taylor & Weber

[57] ABSTRACT

Drinking implements or utensils are devised by assembling various components having distinctive decorative features. A cup assembly is provided with a threaded ferrule at the base thereof for receiving a threaded pin at the end of a stem assembly. A decorative collar is interposed between the two and adapted for covering and concealing the ferrule in a fashionable manner. A candle holder based upon the same modular assembly technique is also presented.

12 Claims, 2 Drawing Sheets

STEM WARE

TECHNICAL FIELD

The invention herein resides in the art of drinking implements and utensils. More particularly, the invention relates to crystal and formal stem ware in which the cup portion is removable from and interchangeable with a plurality of stem configurations. The concept of the invention also extends to candle holders.

BACKGROUND ART

It is well known that the type of drinking goblets, glasses, or crystal used for serving drinks is most desirably tailored to the type of drink being served, the nature of the social function, and the character of the surrounding environment. Previously, a multiplicity of goblets, glasses, or crystal have been required to satisfy the various occasions and decors in which drinks are served. A given cup portion of a goblet or piece of crystal stem ware may be combined with any of numerous stems and bases to tailor the resulting drinking utensil for a particular use in a given environment. Indeed, the stems and bases attached to the cup typically assert the decorative tone of the utensil as a whole.

Accordingly, it is most desirable to have interchangeable stems and cup portions of goblets and other drinking utensils to generate numerous combinations and permutations of drinking implements and devices. It is also most desirable to provide candle holders which coordinate with or complement such drinking utensils, having similar interchangeable parts.

The prior art has taught various types of drinking implements in which the base and receptacle can be attached, separated, and reattached. Particularly, concepts of general interest are show in U.S. Pats. Nos. 3,481,731, 809,567, 2,120,862, 2,054,245, 2,664,004, 2,169,426, 1,801,281 and 1,986,958. However, none of the prior art structures teach the implementation of any of a plurality of stem assemblies with any of a plurality of cup assemblies, and in which the area of interconnection between the two may be concealed by means of any of a plurality of decorative collars. Further, the prior art does not present a structure of constituent parts which is adapted for ease of storage and retention. Additionally, the prior art is truly devoid of any teaching of an effective means for devising a plurality of combinations and permutations of stem ware assemblies.

DISCLOSURE OF INVENTION

In light of the foregoing, it is a first aspect of the invention to provide stem ware in which the cup and stem are separable.

Another aspect of the invention is the provision of stem ware in which one cup can be interchanged with a plurality of stems.

Yet a further aspect of the invention is the provision of stem ware in which one stem can be interconnected with a plurality of cups.

An additional aspect of the invention is the provision of stem ware which includes means for storing both cups and stems in a sanitary inverted position.

Yet a further aspect of the invention is the provision of stem ware which is easy to construct, durable and reliable in use, and given to implementation for various uses in various environments.

Another aspect of the invention is the provision of stem ware in the form of a candle holder formed by the assembly of a plurality of interchangeable parts.

The foregoing and other aspects of the invention which will become apparent as the detailed description proceeds are achieved by a drinking utensil, comprising: a cup portion; and a stem portion, said stem portion being removably connected to said cup portion.

Other aspects of the invention which will become apparent herein are obtained by a utensil of the stem ware type, comprising: a cup; a stem; means interposed between said cup and a first end of said stem for removably interconnecting said stem and said cup; and a base connected to a second end of said stem.

DESCRIPTION OF DRAWING

For a complete understanding of the objects, techniques and structure of the invention reference should be made to the following detailed description and accompanying drawing wherein.

BEST MODE FOR CARRYING OUT THE INVENTION

Figure 1:
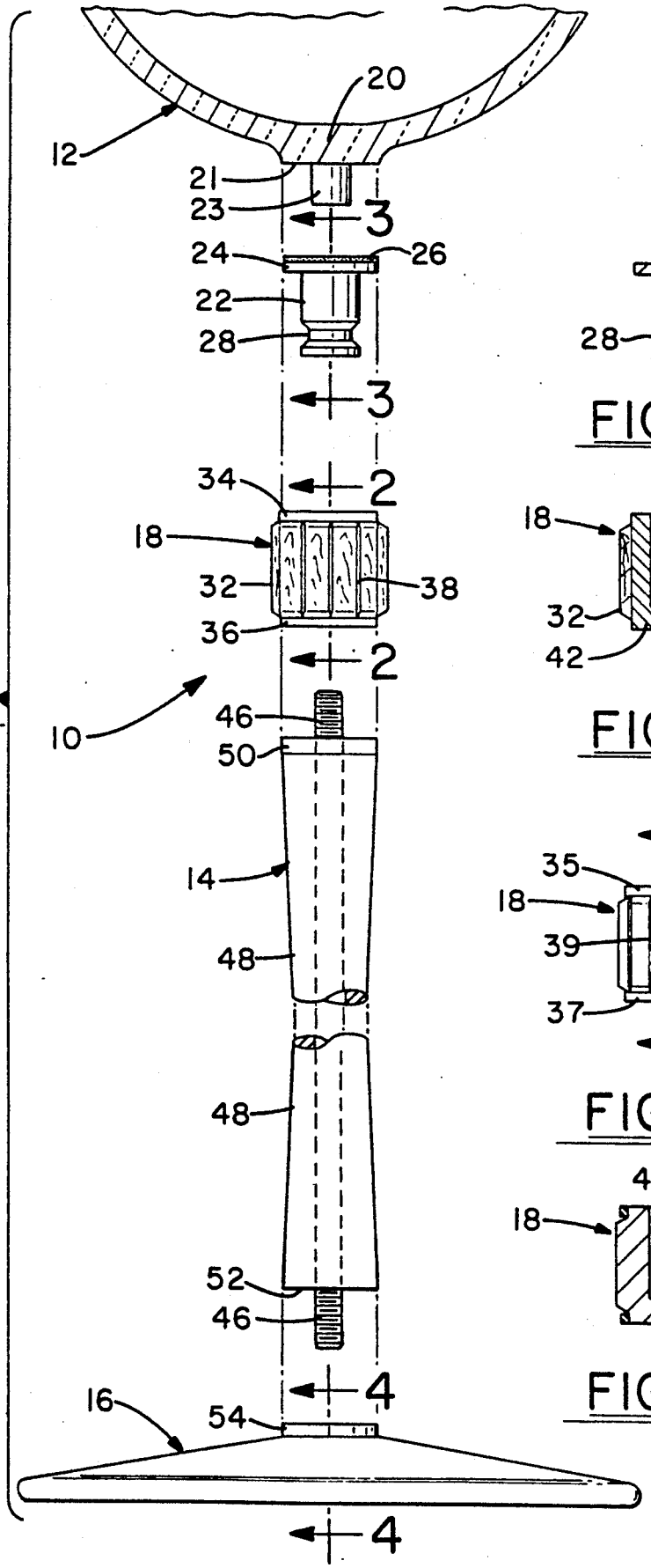
FIG. 1 is an assembly diagram of an embodiment of the invention.

Referring now to the drawing and more particularly FIG. 1, it can be seen that a stem ware assembly according to the invention is designated generally by the numeral 10. As is well known to those skilled in the art, the stem ware assembly 10 includes a cup portion 12 comprising a receptacle for receiving a serving of beverage. A stem portion 14 is also provided, the same having a disc-like base 16 at one end thereof. A collar 18 is interposed between the cup portion 12 and stem portion 14 to conceal the interconnection between the two in a manner to be discussed below.

As shown in FIG. 1, the cup 12 is provided with a base portion which comprises an enlarged and thickened glass or crystal area 20 having a flat surface 21 at the bottom thereof and from which extends a short stem or rod 23. The flat surface 21 and stem or rod 23 may be formed integral with the cup 12 at the time of manufacture, or may be formed by cutting and grinding the crystal stem of a piece of crystal stem ware. The stem or rod 22 is received by and bonded to a ferrule 22. In a preferred embodiment of the invention, the ferrule 22 is of metallic construction, but it will be appreciated that the same may be constructed of any suitable material such as plastic or the like. Typically, the ferrule 22 is of cylindrical nature.

Figure 3:
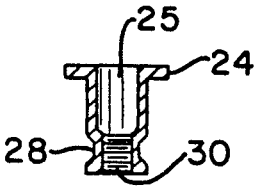
FIG. 3 is a cross sectional view at the ferrule employed in the assembly of FIG. 1, taken along the line 3—3.

As shown in FIGS. 1 and 3, the ferrule 22 includes a shoulder 24 at a top end thereof to abut the flat surface 21 when the bore 25 receives the rod 23. An appropriate bonding media 26 such as epoxy, a thin film of permanent adhesive, or the like is interposed between the surface 21 and shoulder 24, and the stem 23 and bore 25. Accordingly, the ferrule 22 is effectively part and parcel of the cup portion 12, permanently secured thereto. In a preferred embodiment of the invention, the ferrule and glass are bonded by use of LOCTITE 707 Activator and LOCTITE 324 Speed Bonder, demonstrator suitable thermal characteristics to endure temperatures of +275° F. to −65° F.

As shown in FIGS. 1 and 3, the ferrule 22 has a circumferential groove 28 about an exterior surface thereof. The circumferential groove 28 is adapted for receipt by a storage rack comprising parallel rails having a thickness less than the thickness of the groove 28, and being spaced apart a distance less than the external diameter of the ferrule 22, but greater than the inner diameter of the groove 28. A threaded bore 30 passes axially through the ferrule 22 for purposes of mating with the stem portion 14 in a manner to be discussed below.

It will be appreciated that the collar 18 may be of any of numerous designs or configurations. By way of example only, a preferred embodiment of the invention teaches that the collar 18 include a body member 32 which is preferably cylindrical and formed from wood or an appropriate synthetic material. Top and bottom decorative rings or discs 34, 36 are received by the cylindrical body member 32 as shown, the same being devised of stone, a complementary wood, or an appropriate synthetic material. In a preferred embodiment of the invention, the decorative rings or discs 34, 36 may be of the same material as the base 16, or may be formed of a material to complement the same.

Axial grooves or flutes 38 are provided in the exterior surface of the cylindrical body member 32. The grooves or flutes 38 may remain open as in the embodiment of FIGS. 1 and 2 or, as the embodiment of the invention of FIGS. 5 and 6, the same can be populated with strips of material the same as, or complementing, the material of the rings 34, 36.

Figure 2:
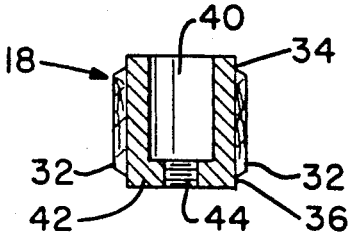
FIG. 2 is a cross sectional view of the collar portion of the assembly as shown in FIG. 1, taken along the line 2—2.

As is apparent from FIG. 2, the collar 18 is characterized by a partial depth bore 40 which is configured to receive the ferrule 22, with the bore 40 having a depth greater than or equal to the length of the body of the ferrule 22 such that the shoulder 24 thereof seats on the top edge of the collar 18 as at the decorative ring 34. A disc-like base member 42 closes the bottom of the collar 18. A bore 44 passes axially through the base member 42 and disc 36 in alignment with the threaded bore 30 of the ferrule 22.

It will be appreciated that the rings or discs 34, 36 serve as end caps to the body member 32 of the collar 18. Typically, the discs 34, 36 are solid, but for the respective bores 40, 44 passing therethrough. They are secured to the ends of the body member 32 by an appropriate bonding agent or adhesive such as LOCTITE 454.

Figure 5:
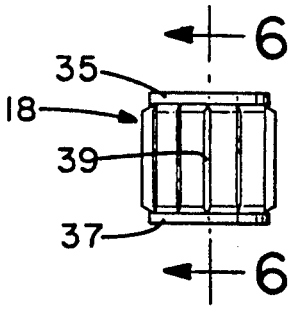
FIG. 5 is a perspective view of an alternate embodiment of the collar employed in the invention.
Figure 6:
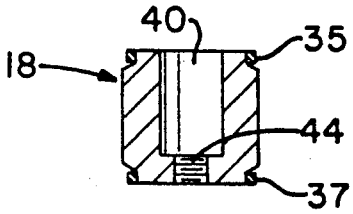
FIG. 6 is a cross sectional view of the collar of FIG. 5, taken along the line 6—6.
Figure 4:
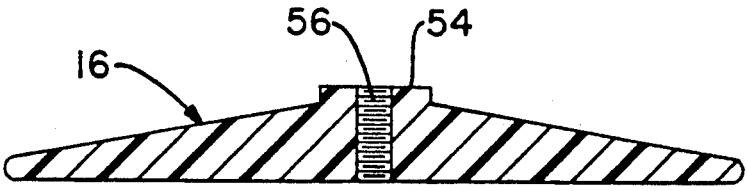
FIG. 4 is a cross sectional view of the base employed in the assembly of FIG. 1, taken along the line 4—4.

As shown in FIGS. 5 and 6, the collar 18 may be turned from solid stock, allowing the discs 34, 36 to be replaced by bands 35, 37. Inlays 39 of decorative material may be received within the axial grooves or flutes 38, complementing the bands 35, 37 or other portions of the assembly 10 considered as a whole.

The stem portion 14 may again be of any suitable nature or material, such as being turned from woods such as walnut, cherry, rosewood, teak, and the like. A threaded rod 46 extends axially from both ends of the shaft 48 of the stem portion 14. With the rod 46 passing completely and axially through the shaft 48, not only is the shaft strengthened, but the rod 46 also provides a suitable means for "chucking" the shaft 48 so that it may be turned on a suitable lathe for forming. One end of the shaft 48 is characterized by a shoulder 50 which, in the assembly of the stem ware unit 10, abuts the bottom of the base member 42 or the disc 36 of the collar 18. The other end of the shaft 48 has a shoulder 52 which abuts a plateau 54 on the base 16 during assembly.

It will be readily appreciated by those skilled in the art that the cup portion 12, collar 18, stem portion 14, and base 16 may all be of various designs, materials, and configurations. It will readily be appreciated that at least four subassemblies may be interconnected using the structure presented above to achieve various combinations and permutations of structural interconnection. Such subassemblies include the cup portion 12, the collar portion 18, the stem portion 14, and the base portion 16. It will be appreciated that the base 16 is devised with a threaded bore 56 to be separable from the stem 48 by selective threaded engagement with the rod 46.

It will readily be appreciated that a suitable cup 14 having a ferrule 22 extending therefrom can first be selected. An appropriate collar 18 may then be placed upon the ferrule 22 to conceal the same. The threaded pin 46 may then be inserted through the bore 44 of the collar 18 for threaded engagement with the bore 30 of the ferrule 22, seating the shoulder 50 against the disc 36 or base member 42. In similar fashion, an appropriate base 16 may be selected and the rod 46 threaded into the bore 56 until the shoulder 52 is seated on the plateau 54. Upon tightening of the threaded engagements, the assembly is complete. Disassembly obviously follows the same general routine, but in reverse order.

It will further be appreciated that racks comprising parallel rails may be employed for receiving the plurality of stem assemblies 14, with the bases 16 resting upon the parallel rails. In like manner, specifically spaced parallel rails may be provided to engage the grooves 28 of the ferrules 22 to maintain the cup portions 12 in an inverted and sanitary manner.

It should now be appreciated that the decorative styles and features of the drinking utensils achieved by the concept represented above is limited only by the imagination of those employing the invention. Having available a plurality of parts which may be assembled to achieve a desired configuration, the total number of pieces of expensive crystal stem ware or the like may be greatly reduced. Further, should any one of the constituent portions of the total assembly be lost or broken, the utility of the other subassemblies remains.

Figure 7:
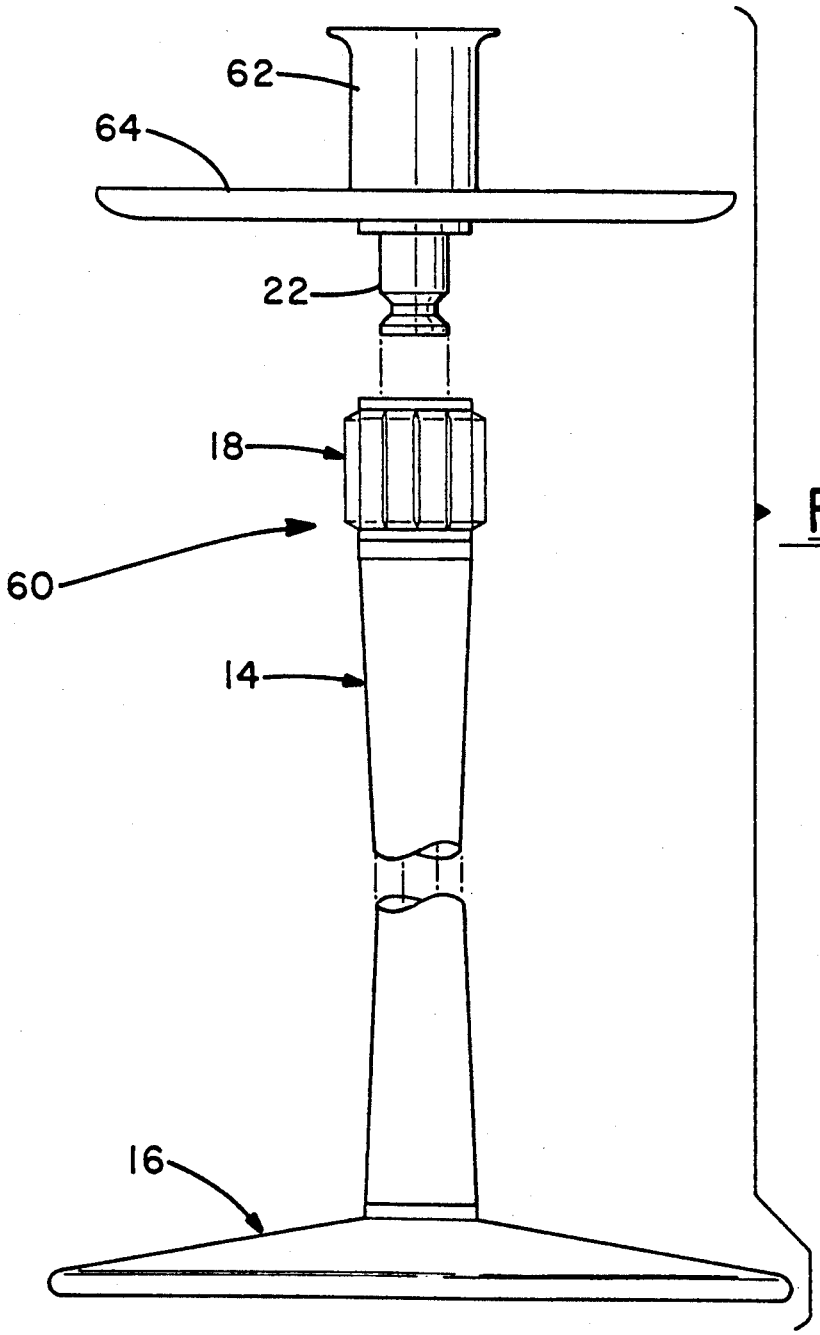
FIG. 7 is an assembly diagram of a candle holder according to the invention.

It should now be appreciated that the concept of the invention may be extended to cover additional items, such as candle sticks or holders. As shown in FIG. 7, a candle holder 60 may comprise substantially the same structure as the stem ware assembly 10. The stem 14, base 16, collar 18, and ferrule 22 may be identical to those presented earlier herein. The cup 12, however, may be replaced with a suitable cup 62, configured to receive a base of a candle, and being encircled by an appropriate drip plate 64. Of course, the various components of the candle holder 60 may be selected to match or complement the elements of the stem ware with which the candle holders may be used.

Thus it can be seen that the objections of the invention have been satisfied by the structure presented above. While in accordance with the patent statutes only the best mode and preferred embodiments of the invention have been presented and described in detail, it is to be understood that the invention is not limited thereto or thereby. Accordingly, for an appreciation of the true scope and breadth of the invention reference should be made to the following claims.

What is claimed is:

1. A drinking utensil, comprising:

a cup portion;

a stem portion, said stem portion being removably connected to said cup portion:

a ferrule connected to said cup portion, said ferrule engaging said stem portion, said ferrule having a threaded bore axially therein:

a threaded pin extending from an end of said stem portion for engagement with said threaded bore of said ferrule; and a collar receiving and concealing said ferrule, and interposed between said cup portion and said stem portion, said collar having a partial depth bore receiving said ferrule, and a bottom portion having a bore passing therethrough and receiving said threaded pin, a top edge surface of said collar engaging a shoulder of said ferrule.

2. The drinking utensil according to claim 1, wherein said ferrule has a circumferential groove about an exterior surface thereof for storage of said cup portion in an inverted position.

3. The drinking utensil according to claim 1, wherein said stem portion interconnects with a base at an end thereof opposite an end having said threaded pin.

4. The drinking utensil according to claim 3, wherein said collar has decorative bands about ends thereof, said bands being of a same material as that comprising said base.

5. A utensil of the stem ware type, comprising:

a cup;

a stem comprising a solid elongated shaft having a threaded pin passing axially therethrough and extending from first and second ends thereof, said pin strengthening and reinforcing said shaft;

a ferrule having a threaded bore axially therein interposed between said cup and said first end of said stem for removably interconnecting said stem and said cup; and a base connected to said second end of said stem.

6. The utensil according to claim 5, wherein said cup has a rod extending therefrom, said rod being securely received by said ferrule.

7. The utensil according to claim 6, wherein said ferrule has a circumferential groove about an exterior surface thereof.

8. The utensil according to claim 5, further comprising a collar receiving said ferrule.

9. The utensil according to claim 8, wherein said collar has a partial depth bore therein terminating at an end disc, said end disc having a bore therein for receiving a first end of said threaded pin and in alignment with said threaded bore of said ferrule.

10. The utensil according to claim 9, wherein said collar abuts a shoulder of said ferrule at one end thereof, and abuts said first end of said stem at said second end thereof.

11. The utensil according to claim 10, wherein said collar receives decorative inlays of a material comprising said base.

12. The utensil according to claim 10, wherein said base has a bore therein for receiving a second end of said threaded pin.

* * * * *